US008353065B1

(12) United States Patent
Crye

(10) Patent No.: US 8,353,065 B1
(45) Date of Patent: Jan. 15, 2013

(54) CONFIGURABLE BODY ARMOR

(75) Inventor: Caleb Clark Crye, Brooklyn, NY (US)

(73) Assignee: LineWeight LLC, Brooklyn, NY (US)

( * ) Notice: Subject to any disclaimer, the term of this patent is extended or adjusted under 35 U.S.C. 154(b) by 1376 days.

(21) Appl. No.: 11/972,528

(22) Filed: Jan. 10, 2008

(51) Int. Cl.
*A41D 1/04* (2006.01)

(52) U.S. Cl. ..... 2/102; 2/2.5

(58) Field of Classification Search ..... 2/2.5, 92, 2/94, 102, 462, 463, 465, 467
See application file for complete search history.

(56) References Cited

U.S. PATENT DOCUMENTS 5,060,314 A * 10/1991 Lewis ..... 2/2.5
5,495,621 A * 3/1996 Kibbee ..... 2/2.5
6,185,738 B1 * 2/2001 Sidebottom ..... 2/2.5
6,769,137 B2 8/2004 D'Annunzio
6,892,392 B2 * 5/2005 Crye et al. ..... 2/2.5
6,948,188 B2 9/2005 D'Annunzio
7,636,948 B1 * 12/2009 Crye et al. ..... 2/2.5

FOREIGN PATENT DOCUMENTS

CA 642244 6/1962

* cited by examiner

*Primary Examiner* — Katherine Moran
(74) *Attorney, Agent, or Firm* — Stiennon & Stiennon

(57) ABSTRACT

A body armor system has a left vest section connected to a right vest section and has a front plate carrier which is alternatively mounted with a buckle at either the right shoulder or the left shoulder. The front plate carrier has identical straps terminated by patches of hook and loop fastener material. One strap is passed through a loop on the rear of the front plate carrier and mounts one part of a buckle, the other part of the buckle is mounted on a hook and loop fastener strap which is affixed to a shoulder element, thus permitting the system to be reconfigured for left- or right-handed users. U-shaped ballistic inserts are received in mating pockets in each vest section. A laced cord which joins the rear segments of the vest sections is held in place by a cord restraint member which defines a loop for each cord crossing.

12 Claims, 6 Drawing Sheets

CONFIGURABLE BODY ARMOR

CROSS REFERENCES TO RELATED APPLICATIONS

Not applicable.

STATEMENT AS TO RIGHTS TO INVENTIONS MADE UNDER FEDERALLY SPONSORED RESEARCH AND DEVELOPMENT

Not applicable.

BACKGROUND OF THE INVENTION

The present invention relates to body armor systems worn for protection against projectile threats such as rifle and handgun bullets, and shrapnel.

Persons exposed to projectile threats, such as police officers and soldiers, may seek a certain level of protection by wearing armored clothing. Low velocity projectiles such as handgun rounds, fragmentation rounds from a grenade or mortar, and miscellaneous shrapnel may be countered by so-called "soft armor." Soft armor is worn in the form of jackets, vests, etc. which are composed of assemblies of ballistic fabric such as those formed from DuPont Kevlar® fibers. The soft armor is often fabricated as flexible panels which are received within pockets or pouches formed in fabric vests or jackets. In more serious threat situations, where higher velocity rifle rounds must be countered, soft armor has typically been supplemented with hard armor fabricated of rigid plates of ceramic, polymer, or metal.

Body armor can contribute to the safety of a soldier in combat situations, but it is important that it not significantly detract from the soldier's ability to perform combat tasks, and that it not be an impediment to providing assistance to the soldier in the event of injury. Thus, while a body armor system should be securely mounted to the soldier, it should be rapidly removable in an emergency. In some systems, an emergency release pin is provided which engages with lacing held in place by eyelets which are threaded on the pin. By rapidly withdrawing the pin, the body armor can by opened up and the wearer expeditiously extricated. Yet this arrangement can result in the lacing and released eyelets becoming tangled or disarrayed, making reassembly of the armor a time-consuming task.

It is furthermore important that the structure of the body armor should not interfere with the soldier's weapons use. A significant fraction of soldiers are left-handed, and thus the configuration of some body armor must be different depending on the soldier's handedness. To efficiently make use of resources, it is desirable that a single armor system be able to accommodate both left and right handed wearers.

What is needed is a body armor system which can be readily configured for different users, and which can be rapidly disassembled and reassembled.

SUMMARY OF THE INVENTION

A body armor system has a left vest section connected to a right vest section and has a front plate carrier which is alternatively mounted with a buckle at either the right shoulder or the left shoulder. The front plate carrier has identical straps terminated by patches of hook and loop fastener material. One strap is passed through a loop on the rear of the front plate carrier and mounts one part of a buckle, the other part of the buckle is mounted on a hook and loop fastener strap which is affixed to a shoulder element, thus permitting the system to be reconfigured for left- or right-handed users. U-shaped ballistic inserts are received in mating pockets in each vest section. A laced cord which joins the rear segments of the vest sections is held in place by a cord restraint member which defines a loop for each cord crossing.

It is an object of the present invention to provide a body armor system which can be configured for either a left-handed or a right-handed user.

It is another object of the present invention to provide a body armor system with a quick-release assembly which retains the laced rear connecting cords in order for rapid reassembly of the system after activation of the quick release.

It is also an object of the present invention to provide a body armor system with removable ballistic inserts which seamlessly provide protective coverage for portions of a wearer's front, back, and side.

It is a further object of the present invention to provide a body armor system with a front plate carrier which is easy to doff and don.

Further objects, features and advantages of the invention will be apparent from the following detailed description when taken in conjunction with the accompanying drawings.

DESCRIPTION OF THE PREFERRED EMBODIMENTS

Figure 1:
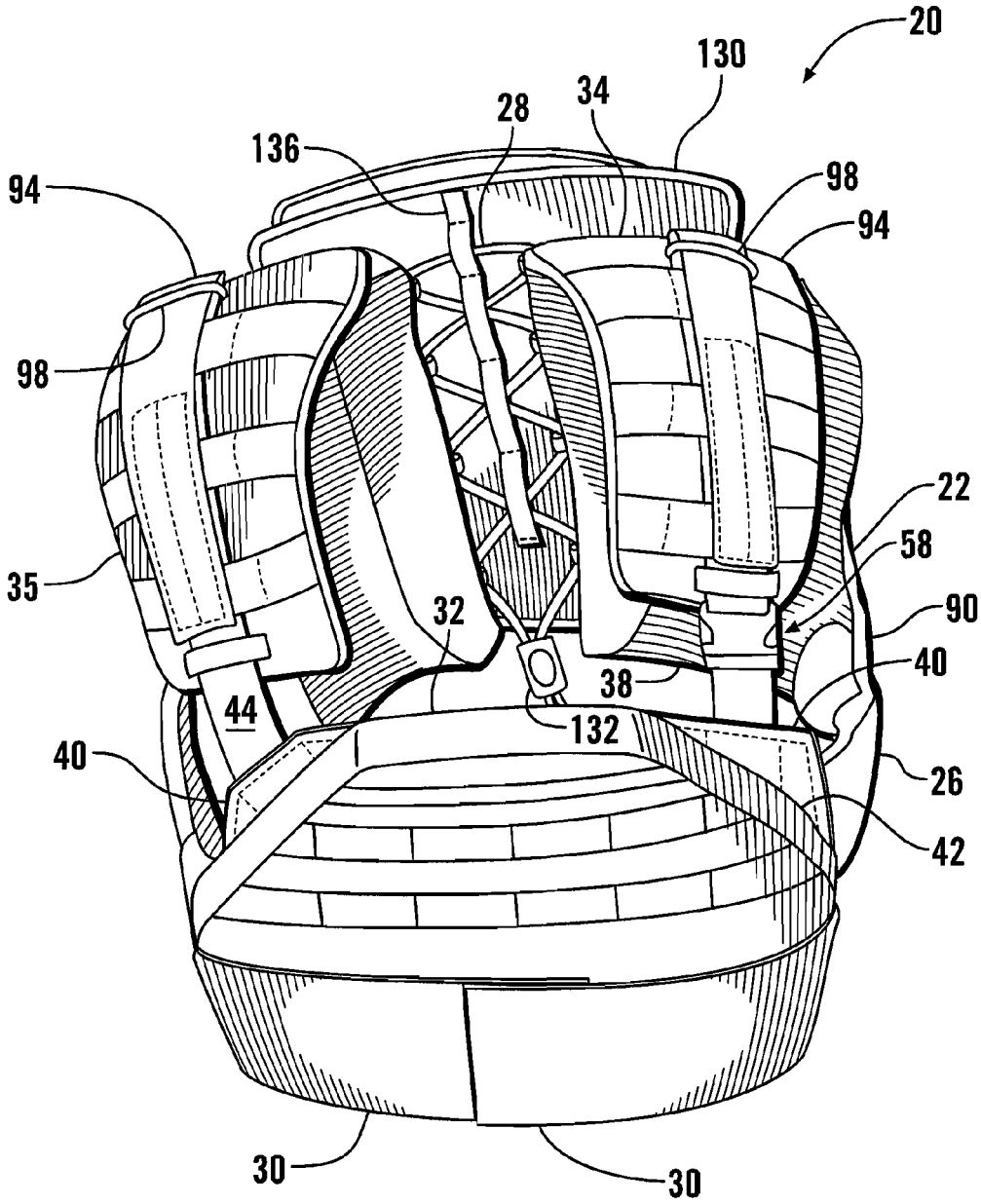
FIG. 1 is a front top perspective view of the body armor of this invention configured for a right-handed user.

Referring more particularly to FIGS. 1-8 wherein like numbers refer to similar parts, a body armor system 20 is shown as worn by a user in FIG. 1. The body armor system 20 has a vest 22 comprised of two sections which are substantially mirror images of one another, a left vest section 24 and a right vest section 26. The vest sections 24, 26 are laced together by a cord 28 at the rear, and are closed at the front by a cummerbund arrangement of overlapping wide fabric bands 30 which have the parts of a two-part hook and loop fastener such as VELCRO® fastener manufactured by Velcro Industries B.V. The cummerbund bands 30 extend in front of a fabric front plate carrier 32 which encloses a front plate (not shown) which is a ballistic element, typically a hard armor element.

By "ballistic element" is meant an element of soft or hard armor, configured to resist ballistic projectiles or fragments. A soft armor ballistic element may be conventional soft armor, i.e., assemblies of ballistic fabric such as those formed from DuPont Kevlar® fibers, fibers of Spectra® ultra high molecular weight polyethylene fibers from Honeywell, or other ballistic material. The hard armor ballistic elements may be, for example, fabricated of rigid plates of ceramic, polymer, or metal.

Figure 2:
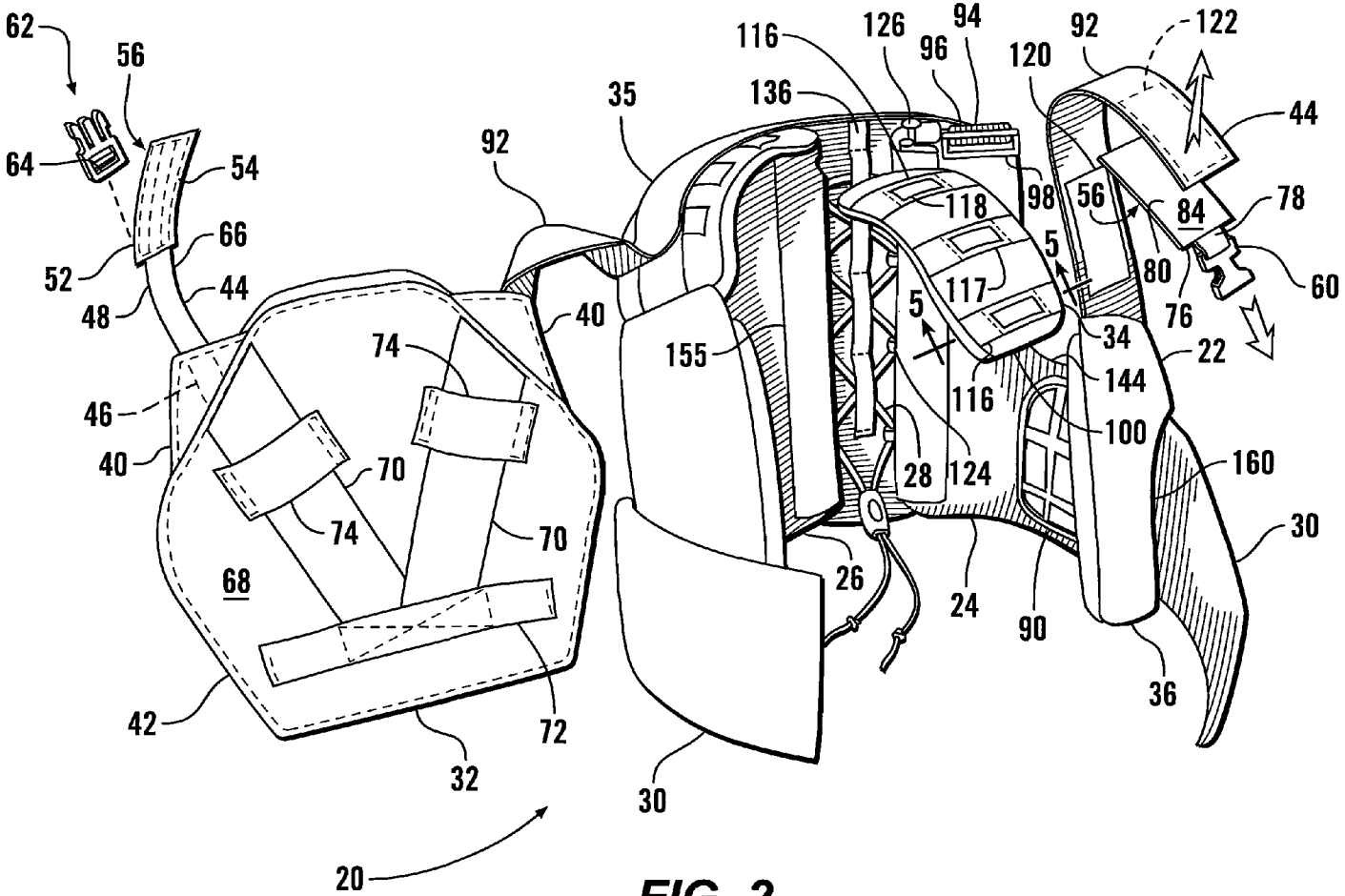
FIG. 2 is an exploded front perspective view of the body armor of FIG. 1 partially disassembled for reconfiguration to use by a left-handed user.

Two padded shoulder elements 34, 35 extend between the front segment 36 and the rear segment 38 of each vest section, and the front plate carrier 32 is connected to the shoulder elements, as best shown in FIG. 2. The front plate carrier 32 has a fabric pouch 42 which defines an enclosed pocket which receives the ballistic element front plate. Two triangular flaps 40 extend upwardly from the pouch 42. Two identical front straps 44 are secured to the front plate carrier 32 at the flaps 40. Each front strap 44 is preferably a woven webbing material which has a fixed end 46 which is sewn to one the two triangular flaps 40, and a remote end 48 to which an attachment element 52 is sewn. Each attachment element 52 is preferably wider than the webbing material of the strap, and comprises a hook patch 54 and a loop patch 56 of a hook and loop fastener material, the two patches being placed back to back with the strap 44 therebetween and sewn together.

The front straps 44 serve to mount the front plate carrier 32 to the shoulder elements 34, 35. One strap extends continuously onto one of the shoulder elements, while the other strap is formed into a loop which mounts a buckle assembly 58 for quick release from the other shoulder element. As shown in FIG. 2, the front plate element is thus readily pivoted sidewardly on release of the buckle assembly 58 for convenient donning or doffing of the body armor system. The buckle assembly 58 is a two-part construction, for example a plastic side release buckle comprised of a female end shell 60 and a male end 62 having a plurality of deflectable tongues. The buckle assembly 58 provides convenient and rapid connection and disconnection requiring only a single hand. However, the hard plastic of the buckle assembly which lies in the region of the user's shoulder would interfere with the support of a rifle in use. Hence the buckle assembly 58 may be mounted selectively to be connected to either the left shoulder element 34 or the right shoulder element 35, depending on whether the user of the vest is right-handed or left-handed respectively. By having one assembly which is configurable for both right- and left-handed users, the need to stock quantities of different body armor systems depending on the handedness of the user is eliminated. This is of particular benefit when it is considered that body armor will typically have to be stocked in a range of sizes.

The body armor system 20 is shown configured for a right-handed user in FIG. 1. The buckle male end 62 has a mounting opening 64, as shown in FIG. 2, through which the attachment element 52 on the releasable end 48 of the front strap 44 may be threaded. Because the attachment element 52 is significantly wider than the front strap itself, it is necessary to fold the attachment element along axes parallel to the front strap edges to allow the attachment element to pass through the mounting opening 64 in the buckle male end. Once the buckle male end 62 is threaded on to the front strap 44, the front strap is folded back on itself to define a loop 66, shown in FIG. 1, which retains the buckle male end.

As shown in FIG. 2, the front plate carrier 32 has a rear wall 68 which faces toward the vest 22. Two elongated patches 70 of one half of a hook and loop fastener are fixed to the front plate carrier rear wall 68 extending upwardly and sidewardy from a point below a centerline which divides the upper region from the lower region of the carrier. Thus the two elongated patches 70 form a generally V-shaped configuration on the rear wall of the plate carrier 32. A strip of webbing 72 may be sewn to the rear wall 68 across the lower ends of the elongated patches 70. The elongated patches 70 are chosen to have hook or loop material to mate with an attachment element 52 when it is looped on the front strap to overlie an elongated patch. Thus, in the illustrated example, the elongated patches are loop material. The loop 66 of the front strap positions the attachment element 52 to overlie and be secured to one of the elongated patches 70. It is a property of hook and loop fasteners that they are generally very strong in shear, but are much more readily peeled apart. The connection between the attachment element 52 and the elongated patch 70 is constrained to be primarily in shear by a webbing loop 74 which is sewn to the rear wall 68 of the front plate carrier to extend across the elongated patch 70.

The attachment element 52 extends beneath this loop when it is connected to the elongated patch 70. The overlying loop 74 thereby prevents the attachment element 52 from peeling or pulling away from the elongated patch 70 giving a connection which serves well in tension. A webbing loop 74 is positioned over each of the elongated patches 70, so that either one of the two front straps may be folded to define a loop which retains a buckle end and is secured to the rear wall of the front plate carrier.

As shown in FIG. 1, the female end 60 of the buckle assembly is mounted to a shoulder element, in the case of a right-handed user to the left shoulder element 34. The female end 60 is connected to a buckle mounting strap 76 by a short loop 78 of webbing which is secured to an attachment element 80 comprised of a hook patch 82 and a loop patch 84 of hook and loop fastener material, for example, the hook patch facing downwardly, and the loop patch facing upwardly.

As shown in FIG. 2, each of the vest sections 24, 26 has a front segment 36 and a rear segment 38 spaced rearwardly from the front segment by a side segment 90. A vest strap 92 extends upwardly from each of the vest sections 24, 26, and is secured at its lower end to a vest section front segment 36. The vest straps 92 are preferably the same width as the attachment elements 52, 80, and are longer than the front straps 44. The vest straps 92 extend from the vest front segment 36 to a fastener 94 mounted by a short webbing loop 96 secured to the rear segment 38 of the same vest section. The fastener 94 may be, for example, two steel links 98 retained by the loop 96. The fastener 94 allows spacing between the vest front and rear segments to be adjusted.

Figure 5:
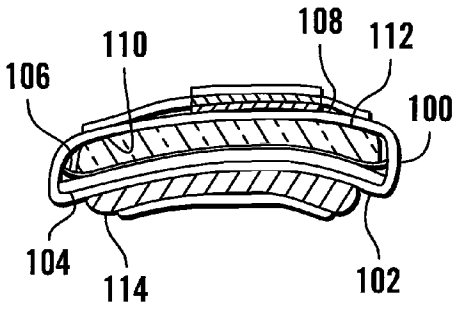
FIG. 5 is a cross-sectional view of a shoulder pad assembly of the body armor of FIG. 4, taken along section line 5-5.

The left shoulder element 34 and the right shoulder element are mirror images of one another, and each has a fabric bag 100. As shown in FIG. 5, the fabric bag 100 may be constructed with a downwardly facing four-way stretch fabric with a water resistant coating lower layer 102, to which layer a sheet of ultra soft open-cell foam 104 is sewn, the foam being about ⅛ to ⅕ inches thick. A fabric divider wall 106 is sewn over the foam layer, and a durable outer layer 108 of, for example, 500d Cordura, faces upwardly. The bag 100 defines an interior compartment 110 which may receive an optional soft closed-cell foam insert which is ⅛ to ⅕ inches thick (not shown), an optional ¼ inch thick soft armor insert (not shown), or an optional ¼ hard armor insert 112, shown in FIG. 5. In addition, a position adjustable foam pad 114 may be attached by hook and loop fasteners to the underside of the bag 100. Other adjustable pads of various dimensions may be attached in various locations on the surface of the vest sections facing towards the user. As shown in FIG. 2, three webbing loops 116 are sewn to the outer layer 108 of the shoulder element bag 100, to define an axially extending tunnel 117 through the three loops. Each loop 116 has a narrow patch 118 of the loop portion of a hook and loop fastener.

Each vest strap 92 has a patch 120 of loop material and a patch 122 of hook material spaced from one another on the same face of the strap, preferably such that the patches do not extend along that length of strap 92 which is received within the fastener 94. As shown in FIG. 2, the buckle mounting strap 76 attachment element 80 overlies the vest strap loop material and is secured by the mating hook and loop fastener material patches. The mated buckle mounting strap 76 and vest strap 92 pass through the tunnel 117 defined by the loops 116 on the shoulder element, and the remainder of the vest strap, after passing through the vest rear segment 38 fastener 94, is looped back to overlie the loop material on the webbing loops 116 as well as the upwardly facing loop material on the buckle mounting strap. The hook material patch 122 on the underside of the vest strap 92 is then secured to these upwardly facing loop materials to secure the vest to the shoulder element, and to secure the buckle mounting strap 76 as well. The female buckle end 60 is then positioned to receive the buckle male end 62 and securely connect the front plate carrier to the left shoulder element 34.

As the right shoulder element 35 is a mirror image of the left shoulder element, it also has a tunnel 117 defined beneath loops 116. The right vest section 26 has a vest strap 92 to which the attachment element 52 on the right front plate carrier front strap 44 is attached by the mating hook and loop fasteners. The vest strap 92 with the mating front strap 44 extends through the tunnel 117 on the right shoulder element, and the vest strap 92 is looped around a fastener 94, as shown in FIG. 1, and adhered by hook and loop fasteners to the loops 116 and the top of the front strap 44.

If it is desired to configure the body armor system 20 for a left-handed user, the buckle mounting strap 76 is simply attached to the opposite vest strap, and the female buckle end 60 is attached to the opposite front plate carrier strap front strap 44. Thus, whether configured for a right-handed or a left-handed user, the front plate carrier may be readily released from its protective position by releasing the buckle, and pivoting the carrier on the remaining attached front strap 44 which continues to retain the front plate carrier securely to the vest 22. The loops 74 prevent the ready extraction of the front strap 44 from its place of attachment to the loop fastener material patches on the rear of the front plate carrier. To assist in extraction or insertion, the attachment patch is folded on itself to expose a like fastener material to the elongated patches 70, this effectively hides the receptive side of the material from the side that grabs it, allowing it to slide easily through the loop.

As shown in FIG. 2, the left vest section 24 is joined to the right vest section 26 in the rear by a single cord 28 which is laced through multiple plastic eyelets 124, a plurality of which are connected to the left vest section, and a plurality of which are connected to the right vest section. Both groups of eyelets 124 project through cut-outs 125 in flexible sheets of material 127 which extend vertically along the rear edges of each vest section rear segment 38. The eyelets 124 are held in place on the respective vest sections by two upwardly extending quick-release members such as rods 126 which extend within each of the folded flexible sheets of material 127. The rods may be formed of flexible DELRIN® polyacetal plastic manufactured by E. I. Du Pont de Nemours and Company Corp., or other stiff material. Alternatively a flexible cable may serve as a quick release member. The cord 28 is laced in a cris-crossing fashion frontwardly of the back plate carrier 130 to extend first through an eyelet mounted to one of the vest sections, and then through an eyelet mounted to the other vest section, passing through alternating eyelets as the lacing proceeds upwardly. Once the cord reaches the uppermost eyelet on one vest section, it is then laced across to the uppermost eyelet on the other section from whence it is laced downwardly, in the process crossing itself at a plurality of cord crossings 134. The eyelets may be molded of plastic of different colors to facilitate correct assembly and lacing.

Figure 3:
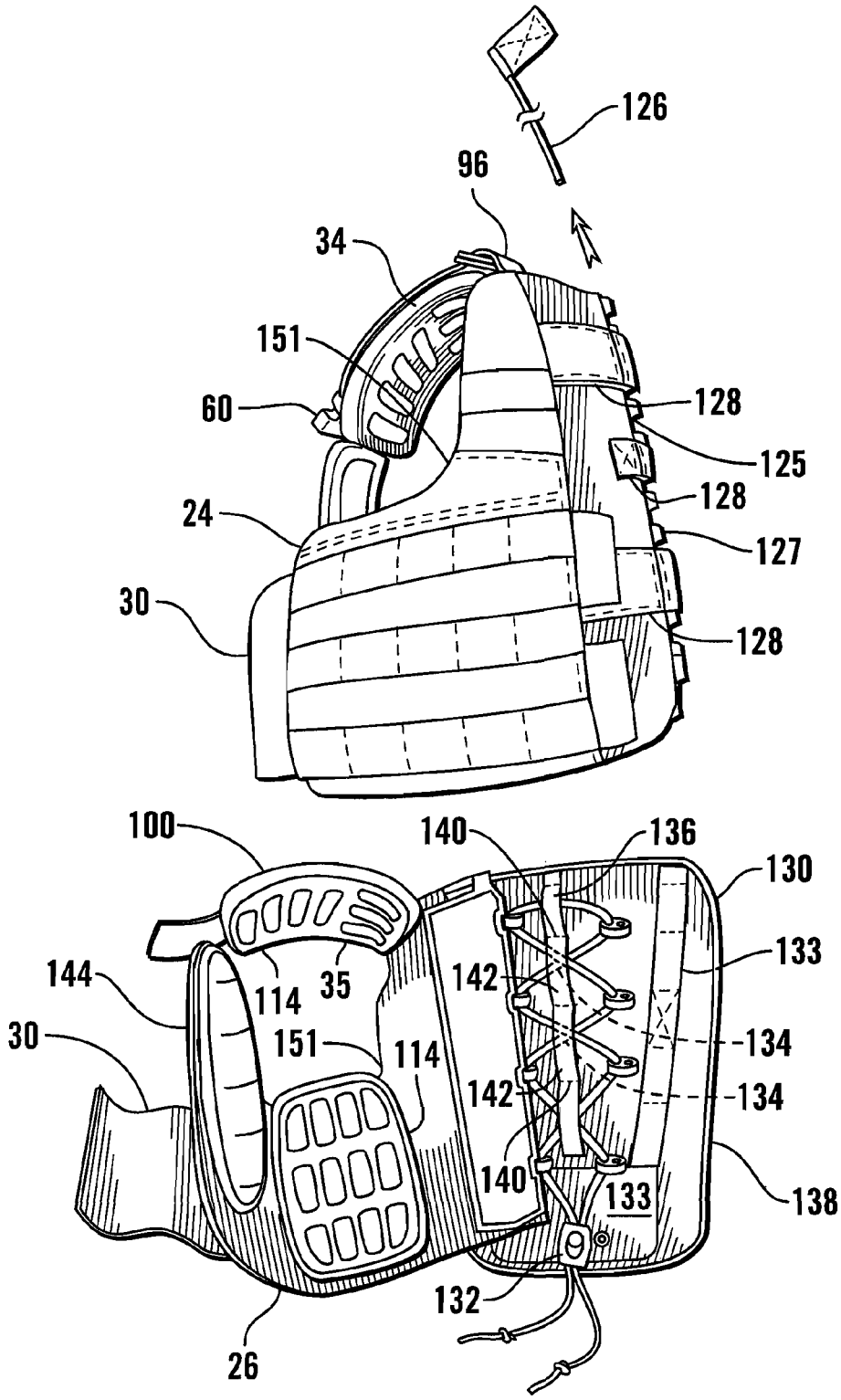
FIG. 3 is an exploded perspective view of the body armor of FIG. 1 shown after withdrawal of the quick-release pin.

The back plate carrier 130 is a fabric pouch which contains a ballistic element such as a hard armor plate. The two ends of the cord extend through a releasable fastener 132 which prevents the retraction of the cord. The ends of the cord and the fastener may be stored in a pouch 135 beneath the cord 28 formed on the back plate carrier. By adjusting the position of the fastener 132 on the cords, and adjusting the lacing spacing, the distance between the vest sections can be adjusted, and the two vest sections may be drawn together to obtain the desired fit of the vest 22 on a wearer. To control the disposition of the cord 28 and the eyelets upon withdrawal of a quick-release rod, a cord restraint member 136 is affixed to a frontwardly facing surface 138 of the back plate carrier 130. The cord restraint member 136 may be a single strip of woven webbing about 1 inch wide, which extends vertically down the center of the back plate carrier 130. The cord restraint member 136 is sewn to the back plate carrier at a number of vertically spaced stitchings 140 which extend sidewardly to define a plurality of restraint member loops 142. The stitchings are positioned such that each restraint member loop 142 opens sidewardly to receive no more than one crossing 134. As shown in FIG. 3, the upper restraint member loop 142 receives only a single length of cord, the next loop down receives a first crossing, the one below that a second crossing and so on with all the loops 142 below receiving one crossing 134.

As shown in FIG. 3, the rods 126 not only releasably hold the eyelets 124 in place, but they also pass through a series of vest webbing loops 128 and back plate carrier webbing loops 133, thereby mounting the back plate carrier 130 to the vest 22 between the left vest section and the right vest section as shown in FIG. 2. When it is necessary for the wearer to rapidly doff the body armor system 20, or to be extracted from the system by others, for example to permit medical attention, one of the quick-release rods 126 is withdrawn, as shown in FIG. 3. With the flexible plastic rod 126 withdrawn, the set of eyelets 124 which had been connected by the rod to a vest section, are no longer connected to that vest section, but are retained entirely by the cord 28. The presence of the cord restraint member 136 serves to preserve the cord in its correct cris-crossed lacing arrangement, with each loose eyelet 124 generally held in a position for ready rethreading on the quick-release rod 126 when it is reinserted, thereby contributing to the ease of reassembly of the body armor system 20 when necessary.

Figure 4:
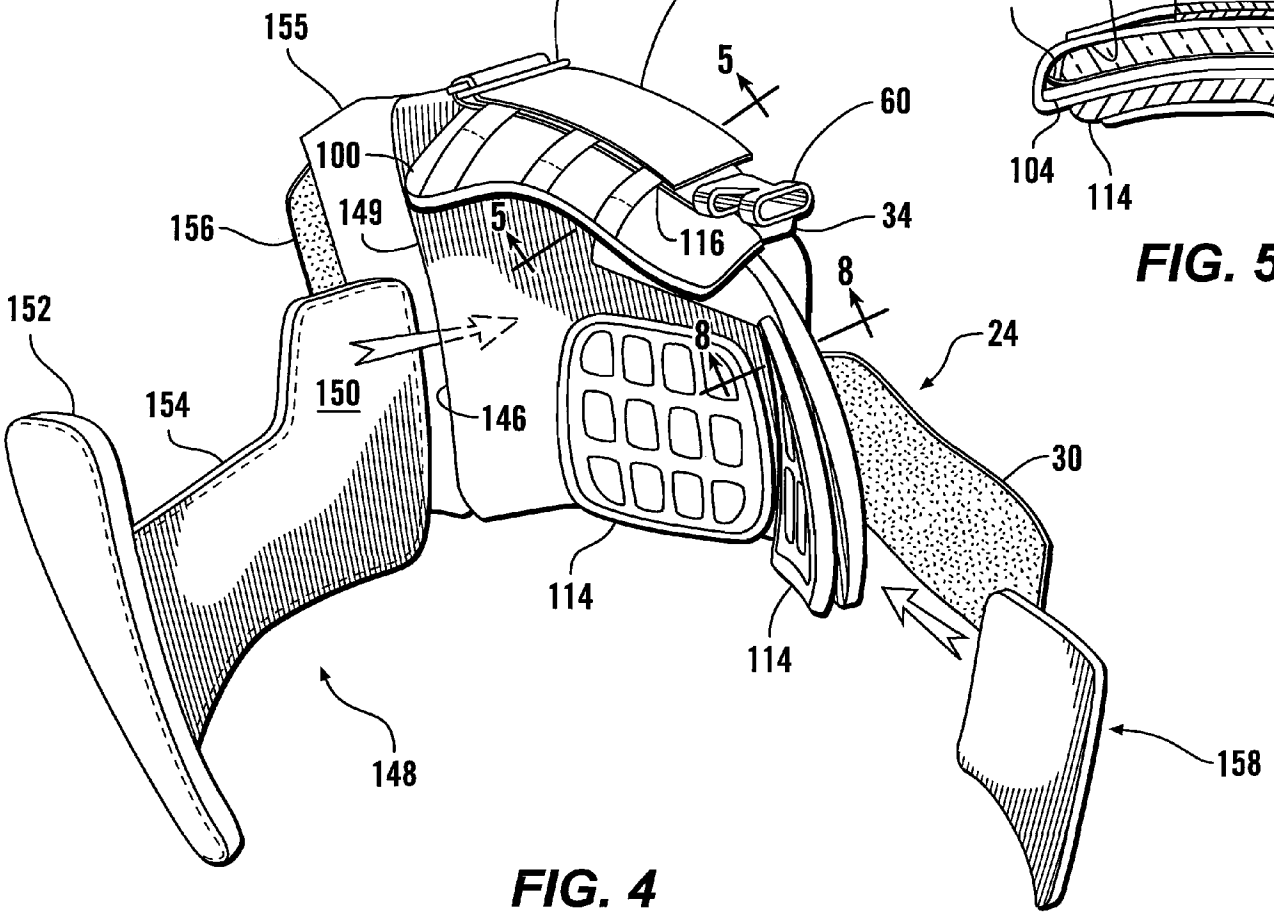
FIG. 4 is an exploded perspective view of a side vest section of the body armor of FIG. 1 showing a hard armor side plate and a side ballistic insert.

Each vest section 24, 26 is comprised of a fabric carrier 144, as shown in FIG. 4, which defines a continuous interior pocket 146. Each vest section has a front segment 36 which is spaced rearwardly from the rear segment 38 by a side segment 90.

Both the front segment 36 and the rear segment 38 extend upwardly a greater amount than the side segment 90. The upwardly extending front and rear segments 36, 38 thereby define an arm opening 151 therebetween and above the side segment 90. The front segment, the side segment, and the rear segment correspond to portions of the fabric carrier which define the continuous interior pocket 146. An opening 149 is defined in the vest section providing access to the interior pocket 146.

Figure 6:
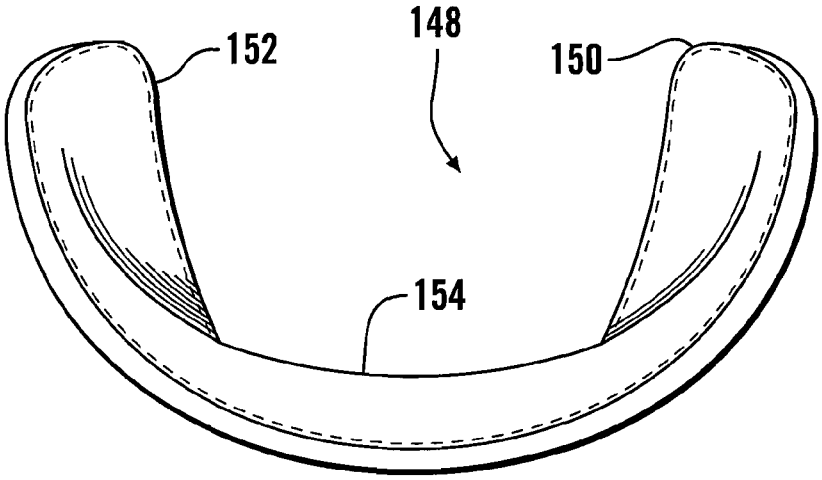
FIG. 6. is a bottom perspective view of the left side ballistic insert of FIG. 4.
Figure 7:
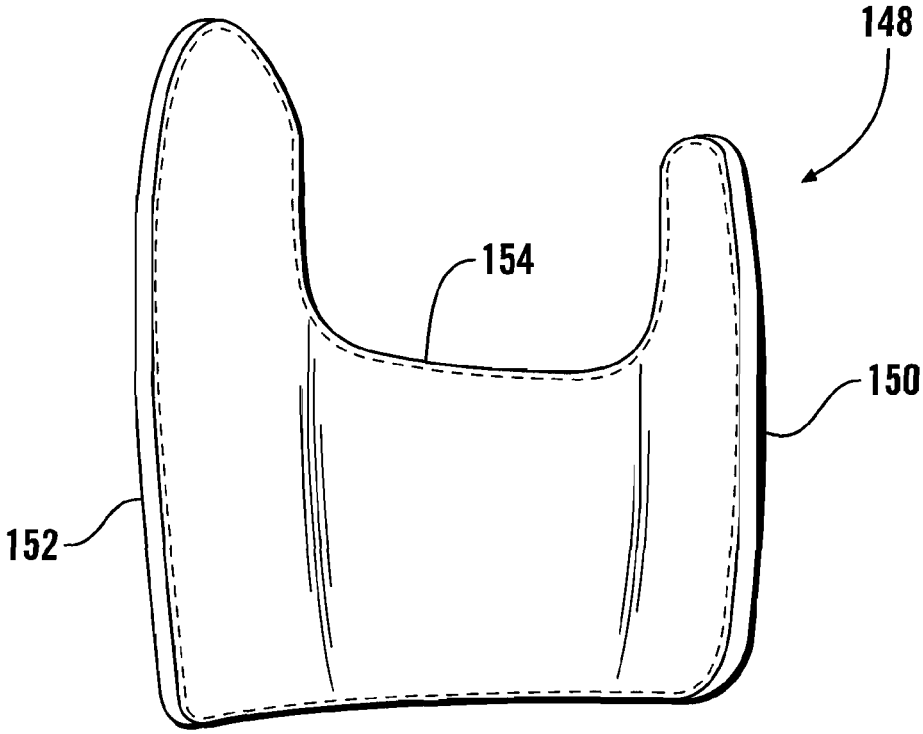
FIG. 7 is a side perspective view of the left side ballistic insert of FIG. 6.

A side ballistic insert 148, shown in FIGS. 4, and 6-7, is formed of ballistic material and is a continuous generally concave bent sheet element which opens towards the opposing vest section. The left side insert 148 is illustrated, but the right side insert is a mirror image of the left side insert. The side ballistic insert 148 has a front segment 150 connected to a rear segment 152 by a side segment 154. The height of the front segment is preferably about 50 percent greater than the side segment. Although the front segment 150 and the rear segment 152 each extend upwardly an amount at least about 50 percent greater amount than the side segment 154, the rear segment 152 is preferably taller than the front segment 150. The side ballistic insert 148 is received within the vest section interior pocket 146. It will be observed that continuous ballistic elements offer an advantage over ones formed of multiple segments in that gaps are avoided which might have a lower level of ballistic protection.

The soft armor ballistic element 148 may be formed as a stack of multiple layers of ballistic material, for example material of Kevlar® fibers, or, for example, layers of Spectra® fiber material. The stack may be stitched around the periphery, in a quilted pattern, or otherwise, to form a stiffer ballistic element. Preferably additional stiffening shape is provided to the ballistic element by adding a stiffening plastic layer, not shown, to the layers of ballistic material. By adding stiffness to the soft armor ballistic element, the component is better able to retain its shape and support loads attached to the component. The plastic layer may be about 1/16 to 1/32 inches thick polycarbonate such as General Electric's Lexan® polycarbonate resin thermoplastic material, and may be adhered or stitched to the ballistic element as disclosed in U.S. Pat. No. 6,892,392, the disclosure of which is incorporated by reference herein. The soft armor ballistic element is then enclosed in the fabric to protect it from wear and soiling. This bag may be a lightweight nylon material. The insert is thus formed into a semi-rigid three-dimensionally shaped soft armor insert, within the fabric carrier.

The side insert 148 is inserted into the vest section fabric carrier through a rear opening 149 which extends substantially the full height of the vest section interior pocket 146 The opening 149 is accessed by folding back a fabric access flap 155 which is retained in place by a strip 156 of hook and loop fastener which engages with the interior surface of the carrier, which serves as a loop portion of the hook and loop fastener. It should be noted that other fastening arrangements could be employed for the flap, such as lacing though eye holes or eyelets, through snaps, a zipper, or any conventional fastening arrangement. The side insert 148 is tipped downwardly when being inserted, so that the front segment 150 extends along the side segment of the vest section before being rotated to extend upwardly within the front segment of the vest section. As shown in FIG. 7, the corners of the side insert 148 are preferably radiused to ease the insertion.

The body armor system 20 may include hard armor side plates 158 which are sections of a cylinder, and curved generally about a vertical axis. The hard armor side plates are generally rectangular, with radiused corners, when viewed from the side, and may be about 1/8 inch thick, and about six inches tall, and six inches measured along the direction of the plate curve. A plate 158, as shown in FIG. 4, is inserted into a frontwardly opening pocket 160 formed on the exterior of the vest section along the vest section side segment 90, as shown in FIG. 2.

Because the insert is removably received within the vest section carrier, numerous manufacturing, warehousing, and configuration advantages are recognized. First, the armor insert is more costly than the carrier that receives it. Because the inserts are readily inserted into carriers of various design, a retailer stocking the body armor can reduce costs by stocking a variety of carriers, for example with different colors or camouflage patterns, for a single armor insert, greatly reducing inventory costs. Moreover, the separation of these two components can permit fabrication of the soft armor at a location remote from the fabrication of the carrier, which can be especially beneficial because the manufacturing technologies are very different. In addition, end users will often desire to customize a body armor system by attaching some special component to it. The construction of the present system permits the carrier to be separated from the armor inserts such that it is much more readily modified or subjected to the addition of sewn elements.

Figure 8:
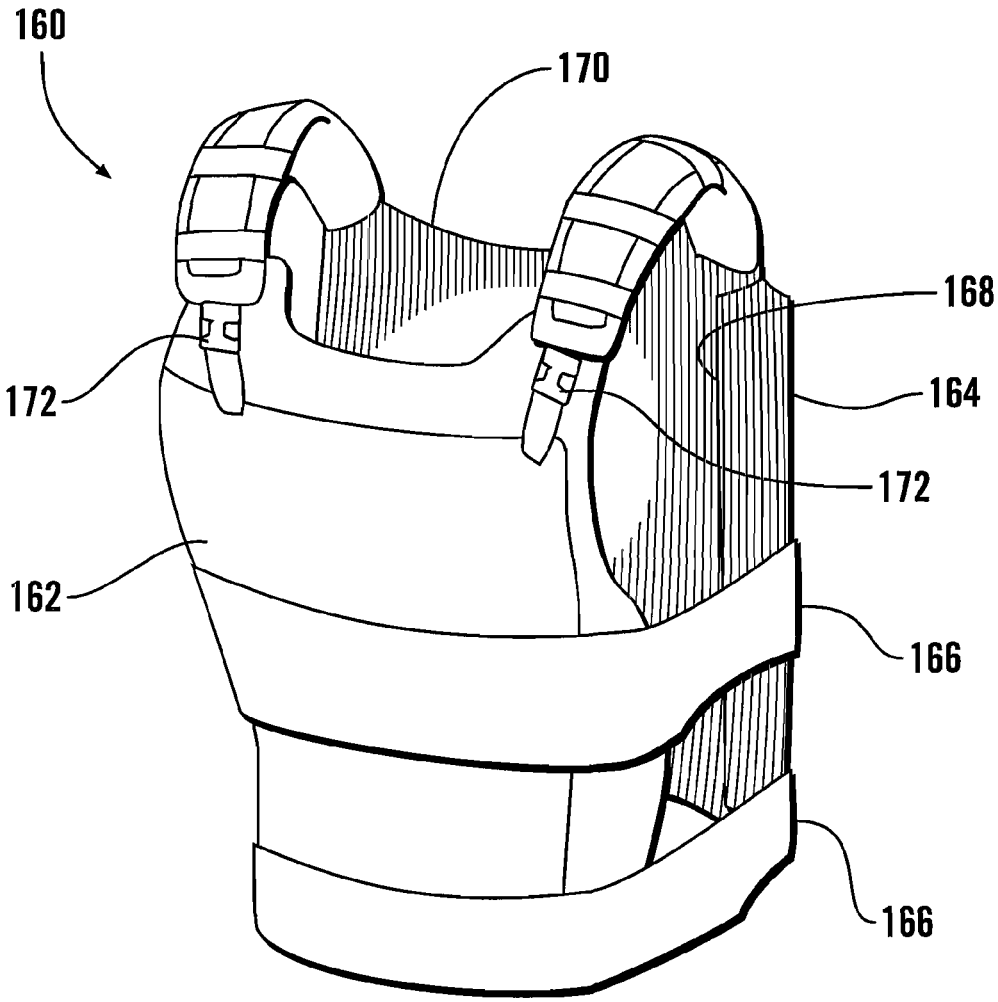
FIG. 8 is a front perspective view of an alternative embodiment body armor system of this invention.

It should also be noted that another conventional type of body armor system involves a front section of the vest which is connected over the shoulders and at the sides to a rear section of vest. For example, such as is shown in U.S. Pat. No. 5,996,115, the disclosure of which is incorporated by reference herein. The carrier and armor insert can also be configured in this fashion. In addition, the configurable front plate carrier and buckle arrangement discussed above can also be applied to such a body armor system. As shown in FIG. 8, the alternative body armor system 160 has a front vest section 162 which is connected to a rear vest section 164 by side straps 166 as well as the shoulder elements of the system 20 discussed above. Both the front vest section 162 and rear vest section 164 are fabric carriers which receive the shaped armor inserts within a pocket, through an opening which is closed by a flap 168 having a fastener which engages the interior fabric wall 170 of the carrier. In the system 160, separate vest straps may not be needed, and the attachment of the front section can be carried to the rear section on the front straps 172 which extend onto a shoulder element or into one half of the buckle assembly.

It is understood that the invention is not limited to the particular construction and arrangement of parts herein illustrated and described, but embraces all such modified forms thereof as come within the scope of the following claims.

I claim:

1. A body armor system comprising:

a vest having front segments and rear segments spaced rearwardly from the front segments;

a first shoulder element fastened between a vest rear segment and a vest front segment;

a second shoulder element fastened between a vest rear segment and a vest front segment and spaced sidewardly from the first shoulder element; and a front plate carrier having a rear wall facing toward the rear segments of the vest;

a first flexible front strap fixed at one end to the front plate carrier;

a second flexible front strap fixed at one end to the front plate carrier;

a buckle mounting strap releasably connected in a first configuration to the first shoulder element;

a buckle assembly comprised of a first end and a second end, the first end and the second end being separable parts which are releasably engaged with one another to form a releasable connection between the first end and the second end, wherein the first end is mounted in a first configuration to a loop formed by the first front strap, and the second end is mounted to the buckle mounting strap, wherein portions of the first front strap spaced from the first end are releasably affixed to the front plate carrier in the first configuration; and attachment portions of the second front strap which are releasably connected to the second shoulder element in the first configuration, the buckle assembly being operable to selectively secure the front plate carrier to the first shoulder element or release it therefrom in the first configuration, and wherein the buckle mounting strap may in a second configuration be releasably connected to the second shoulder element, and the buckle first end in the second configuration may be mounted to the second front strap, and in the second configuration the first front strap extends onto and is secured to the first shoulder element.

2. The body armor system of claim 1 wherein the front plate carrier has portions of a first half of a hook and loop fastener mounted to the rear wall, and further comprising a first and a second loop fixed to the rear wall, the two loops being spaced from each other and each loop extending across a part of the first half hook and loop fastener portions, and wherein the first front strap has a second half of the hook and loop fastener attached thereto, said first front strap extending beneath the first loop in the first configuration.

3. The body armor system of claim 2 wherein the second front strap also has a second half of the hook and loop fastener attached thereto, such that in the second configuration said second half of the hook and loop fastener passes through the second loop.

4. The body armor system of claim 1 wherein the first shoulder element has a plurality of aligned loops affixed thereto which define a tunnel through which the second front strap extends in the first configuration, and through which the buckle mounting strap extends in the second configuration.

5. The body armor system of claim 1 wherein the vest front segments are formed as portions of a first vest section and a second vest section, each having a front segment and a rear segment spaced rearwardly from the front segment, and further comprising:

a first vest strap extending upwardly from the first vest section front segment and extending to the first vest section rear segment, wherein the buckle mounting strap is mounted to the first vest strap in the first configuration, and is mounted to the second vest strap in the second configuration; and a second vest strap extending upwardly from the second vest section front segment and extending to the vest section rear segment, wherein the first front strap is mounted to the first vest strap in the first configuration.

6. A body armor system comprising:

a quantity of hook and loop fastener, comprising first patches of one of the hook or loop material, and second patches of the other of the hook and loop fastener material;

a first vest section having a front segment and a rear segment spaced rearwardly from the front segment;

a second vest section positioned sidewardly from the first vest section and having a front segment and a rear segment spaced rearwardly from the front segment;

a first shoulder element fastened between the first vest section front segment and the first vest section rear segment;

a second shoulder element fastened between the second vest section front segment and the second vest section rear segment;

a front plate carrier having a rear wall facing the vest section front segments having two of the first patches affixed thereto;

two loops connected to the front plate carrier rear wall, each loop extending across one of the first patches;

a first flexible front strap fixed at one end to the front plate carrier and having one of the second patches at an end spaced from the one end;

a second flexible front strap fixed at one end to the front plate carrier;

a buckle mounting strap releasably connected in a first configuration to the first shoulder element;

a buckle assembly comprised of a first end and a second end, the first end and the second end being separable parts which are releasably engaged with one another to form a releasable connection between the first end and the second end, wherein the first end is mounted in a first configuration to a loop formed by the first front strap, and the second end is mounted to the buckle mounting strap, wherein the first strap second patch extends beneath one of the front plate carrier loops and is fixed to the first patch thereunder in the first configuration; and attachment portions of the second front strap which are releasably connected to the second shoulder element in the first configuration, the buckle assembly being operable to selectively secure the front plate carrier to the first shoulder element or release it therefrom in the first configuration, and wherein the buckle mounting strap may in a second configuration be releasably connected to the second shoulder element, and the buckle first end in the second configuration may be mounted to the second front strap, and in the second configuration the first front strap extends onto and is secured to the first shoulder element.

7. The body armor system of claim 6 further comprising:

a first vest strap extending upwardly from the first vest section front segment and extending to the first vest section rear segment, wherein the buckle mounting strap is mounted to the first vest strap in the first configuration, and is mounted to the second vest strap in the second configuration; and a second vest strap extending upwardly from the second vest section front segment and extending to the vest section rear segment, wherein the first front strap is mounted to the first vest strap in the first configuration.

8. A body armor system comprising:

a first vest section having a rear segment;

a second vest section positioned sidewardly from the first vest section and having a rear segment;

a rear plate carrier connected between the first vest section rear segment and the second vest section rear segment;

a plurality of first eyelets connected to the first vest section rear segment;

a plurality of second eyelets connected to the second vest section rear segment by a quick-release member, the second eyelets being spaced from the first vest section rear segment, the quick-release member engaged with the plurality of second eyelets to releasably connect the second eyelets to the second vest section, such that withdrawal of the quick-release member causes the second eyelets to be disconnected from the second vest section;

a cord which is laced between the first eyelets and the second eyelets, such that the spacing of the first vest section from the second vest section is adjustable by adjusting the cord, the laced cord crossing itself at a plurality of crossings; and a cord restraint member affixed to a frontwardly facing surface of the rear plate carrier, the cord restraint member defining a plurality of sidewardly opening loops, wherein the plurality of crossings includes a first crossing and a second crossing, and wherein the first crossing extends within one of the plurality of restraint member loops, and the second crossing extends within another of the plurality of restraint member loops.

9. The body armor system of claim 8 wherein the cord restraint member comprises a strip of fabric material which is stitched to the rear plate carrier, and the strip of fabric material is formed into the plurality of loops by a series of stitchings which are spaced vertically from one another.

10. A body armor system comprising:

a first vest section having a front segment and a rear segment spaced rearwardly from the front segment by a side segment, wherein both the front segment and the rear segment extend upwardly a greater amount than the side segment, to thereby define an arm opening between the front segment and the rear segment, wherein the front segment, the side segment, and the rear segment define a continuous interior pocket, an opening being defined in the first vest section providing access to the interior pocket;

a ballistic insert formed of ballistic material and having a front segment connected to a rear segment by a side segment, the front segment and the rear segment each extending upwardly a greater amount than the side segment, the ballistic insert being received within the first vest section interior pocket through the first vest section opening, wherein the opening is at least as tall as the ballistic insert rear segment a reclosable closure flap on the carrier which selectively covers and reveals the opening giving access to the interior pocket; and a second vest section positioned sidewardly from the first vest section and having a front segment and a rear segment spaced rearwardly from the front segment by a side segment, the second vest section being connected to the first vest section.

11. The body armor system of claim 10 wherein the first vest section front segment and rear segment are at least about 50 percent greater in height than the first vest section side segment.

12. The body armor system of claim 10 wherein the opening is defined in the rear segment of the first vest section, and further comprising a closure flap extending from the rear segment of the first vest section to alternatively cover and reveal the opening.

* * * * *